United States Patent [19]

Sindelar

[11] Patent Number: 5,072,943

[45] Date of Patent: Dec. 17, 1991

[54] PUTTER STABILIZING AND GUIDING SYSTEM

[76] Inventor: Joseph L. Sindelar, 2121 Hancock Dr., Horseheads, N.Y. 14845

[21] Appl. No.: 624,224

[22] Filed: Dec. 7, 1990

Related U.S. Application Data

[63] Continuation-in-part of Ser. No. 540,350, Jun. 19, 1990, Pat. No. 5,024,442.

[51] Int. Cl.[5] ..... A63B 69/36

[52] U.S. Cl. ..... 273/192; 273/194 A

[58] Field of Search ..... 273/186 C, 191 R, 192, 273/193 R, 194 R, 194 A, 186 A

[56] References Cited

U.S. PATENT DOCUMENTS

| | | | |
|---|---|---|---|
| 1,441,492 | 1/1923 | Dwight | 273/164 |
| 1,545,648 | 4/1925 | Fletcher | 273/192 |
| 2,340,793 | 2/1944 | Chapman | 273/192 |
| 2,750,195 | 10/1953 | Ching | 273/183 R |
| 2,754,125 | 7/1953 | Engler | 273/192 |
| 2,776,836 | 1/1957 | Zadina | 273/192 |
| 3,125,343 | 3/1964 | Price et al. | 273/186 R |
| 3,319,964 | 5/1967 | Steinberg | 273/194 A |
| 3,332,688 | 7/1967 | Gevertz | 273/186 R |
| 3,656,752 | 4/1972 | Moriarty | 273/183 E |
| 3,697,080 | 10/1972 | Liotta | 273/186 R |
| 3,753,563 | 8/1973 | Previte | 273/186 C |
| 3,806,133 | 4/1974 | Cork | 273/192 |
| 3,844,569 | 10/1974 | Swanson | 273/192 |
| 4,101,130 | 7/1978 | Richards | 273/187 A |
| 4,153,255 | 5/1979 | Woodson | 273/192 X |
| 4,398,715 | 8/1983 | Hall | 273/25 |
| 4,453,717 | 6/1984 | Solheim et al. | 273/192 |
| 4,688,799 | 8/1987 | Johnson | 273/192 |
| 4,765,624 | 8/1988 | Sprague | 273/183 E |
| 4,805,912 | 2/1989 | Hickman | 273/176 FB |
| 4,927,153 | 5/1990 | Schaefer | 273/187 R |

FOREIGN PATENT DOCUMENTS

| | | | |
|---|---|---|---|
| 26125 | 12/1905 | United Kingdom | 273/192 |

*Primary Examiner*—George J. Marlo

*Attorney, Agent, or Firm*—Cushman, Darby & Cushman

[57] ABSTRACT

A system for practicing putting strokes is provided and which in one form is a putter stabilizer including perpendicularly related planar portions for detachable attachment to a putter and which is used in combination with a planar guide surface to practice putting strokes. The putter stabilizer maintains the longitudinal axis of the putter head substantially perpendicular to the stroke direction to insure that the ball will roll in the direction desired. The use of the putter stabilizer together with a planar putting aid as described will train the golfer's muscles to the particular control and force required for a square putting stroke and for putting a particular distance on the green. In another form, a putter guide system is provided which includes a putter which has a slot defined in the putter head or a putter which has a stabilizer with a slot attached to the putter head and which can be used with a putter guide having an upstanding fin. Sliding engagement of the fin and slot will guide the putter through a desired stroke and will maintain the putter head square.

14 Claims, 5 Drawing Sheets

PUTTER STABILIZING AND GUIDING SYSTEM

This is a Continuation-in-Part of my earlier application Ser. No. 07/540,350, filed June 19, 1990, now U.S. Pat. No. 5,024,442.

BACKGROUND AND SUMMARY OF THE INVENTION

The present invention relates to putting trainers for learning and practicing putting strokes. More particularly, by using the putting aids of the invention, the muscles of the user can be trained to the particular control and force required for using a particular putting stroke and for putting a particular distance on the green.

By way of background, there are two putting methods which are most commonly used by golfers. The first is known as the straight back and straight through method of putting where the draw back, forward stroke and follow through with the putter are all in substantially the same vertical plane. The putter head can be but is not necessarily maintained at a particular distance or height from the putting surface during the entire stroke. The second common putting method is known as the in to in or natural style of putting. With that method, the golfer takes the putter head to the inside that is towards him and slightly up on the back swing, returns it to the ball and then brings it in or towards him and up on the follow through. That putting stroke is similar to a regular golf swing except it is defined at a steeper angle. The in to in method is also known as the in and up method.

Various golf practice devices have been developed for practicing putting strokes. One such putting aid is described in my prior, co-pending patent application Ser. No. 07/540,350 filed June 19, 1990, the disclosure of which is incorporated herein by this reference. The putting system described in the aforementioned application is a training aid which enables the golfer to practice the straight back and straight through method as well as the in to in or in and up putting method so that the user can master both of those putting strokes, train his muscles to consistently employ those strokes on the green and build the confidence required to consistently perform well on the golf course. While that aid is advantageous, that is not to say that further improvement thereof or the use of devices in combination therewith is not possible. Indeed, certain putting aids of the invention may be advantageously used with a putting system of the type described in my prior application.

It is an object of the invention to provide training aids which enable the user to practice a particular putting stroke so that his muscles are trained to the particular control and force required for that particular putting stroke for putting a particular distance on the green and which further maintains the putter square with respect to the stroke direction to ensure that the ball will follow a desired trajectory. Indeed, if the putter head opens up or closes during the stroke, the ball will undesirably be directed to the left or to the right of the target hole or cup.

Thus, it is an object of the present invention to provide putting aids which will ensure that the ball follows a desired trajectory so that the golfer will become accustomed to the feel of a square stroke and his muscles will be trained to repeatedly perform that stroke so that, on the course and/or when the aid is not used, the proper stroke can be reproduced.

Accordingly, in one form, the present invention provides a putter stabilizer for attachment to a putter and which is used in combination with a planer guide surface to practice putting strokes. The putter stabilizer provided in accordance with the present invention maintains the longitudinal axis of the putter head substantially perpendicular to the stroke direction to insure that the ball will roll in the direction desired. The use of the putter stabilizer together with a planer putting aid as described will train the golfer's muscles to the particular control and force required for a square putting stroke and for putting a particular distance on the green.

In another form, the invention provides a putter guide system which includes a putter which has a slot defined in the putter head or a putter which has a stabilizer with a slot attached to the putter head and which can be used with a putter guide having an upstanding fin. Sliding engagement of the fin and slot will guide the putter through a desired stroke and will maintain the putter head square.

Other objects, features, and characteristics of the present invention as well as the methods of operation and functions of the related elements of the structure, and the combination of parts and economies of manufacture, will become more apparent upon consideration of the following description and the appended claims with reference to the accompanying drawings, all of which form a part of this specification, wherein like reference numerals designate corresponding parts in the various figures.

DETAILED DESCRIPTION OF THE PRESENTLY PREFERRED EXEMPLARY EMBODIMENTS

Figure 1:
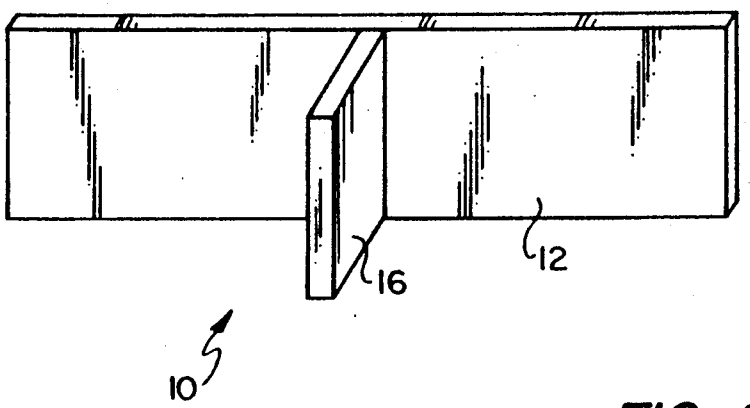
FIG. 1 is a perspective view of a putter stabilizer provided in accordance with a first embodiment of the invention.

As shown in FIGS. 1–4, in accordance with a first embodiment of the invention, the putter stabilizer is a T-shaped stabilizer or "T" adapter 10. The T-adapter 10 has a base portion 12 which is adapted to slide along a planer surface of a putting aid 14, as described more fully below, and a stem or connector portion 16 which is adapted to be connected to the head of the putter 18.

Figure 2:
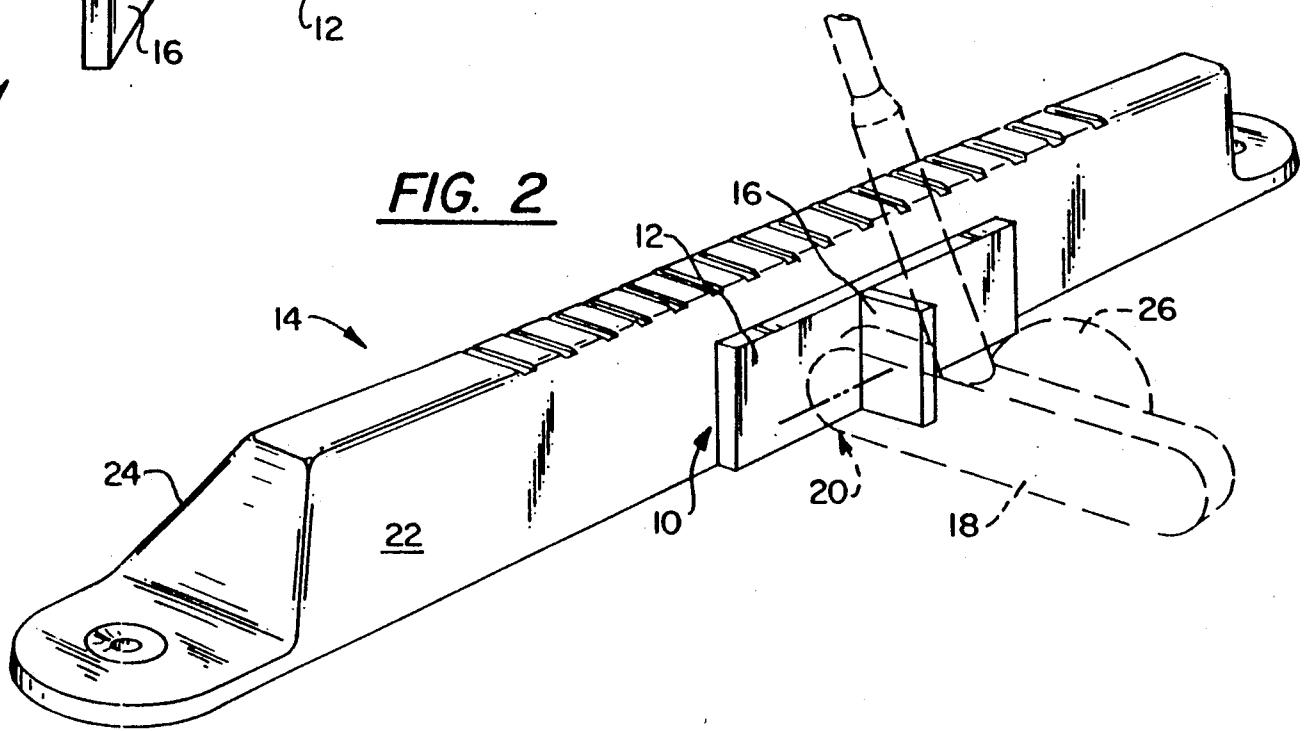
FIG. 2 is a perspective view of a putter stabilizer provided in accordance with the present invention in use in combination with a putting aid having a planer surface.
Figure 4:
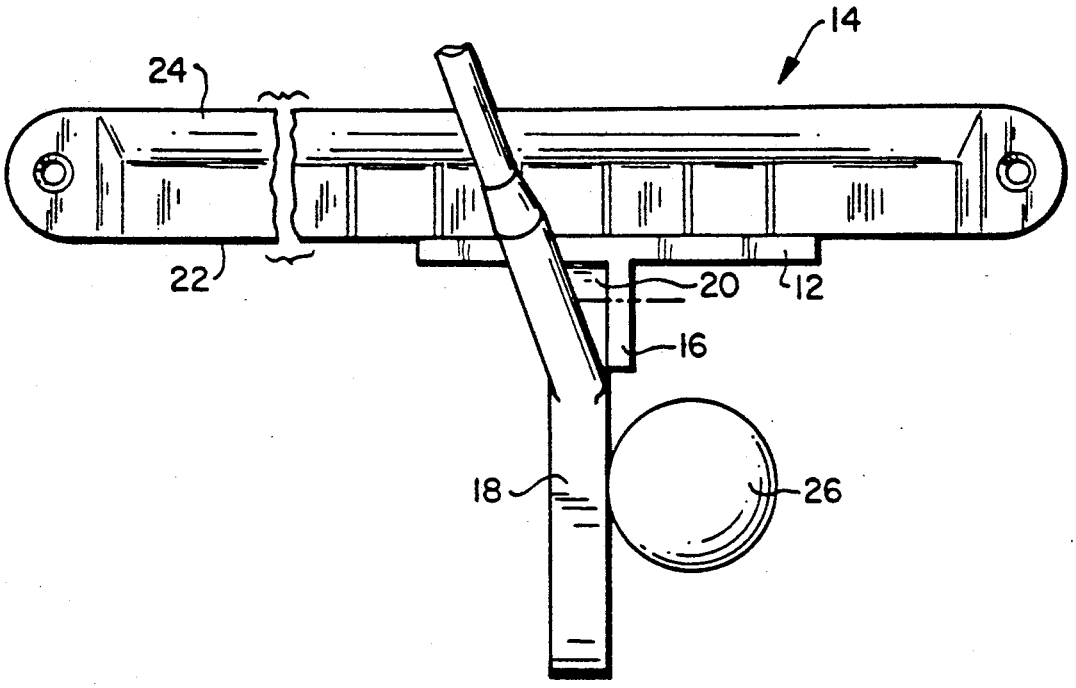
FIG. 4 is a top plan view of the combination depicted in FIG. 3.
Figure 3:
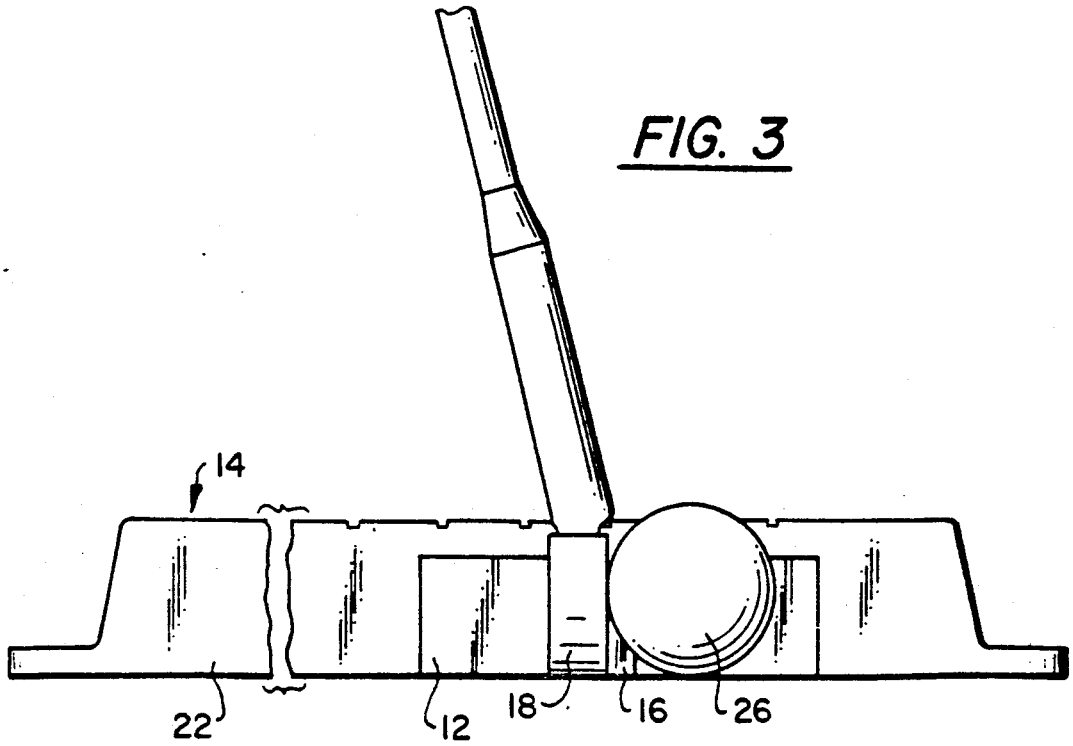
FIG. 3 is a front view a putter stabilizer being used to stabilize a putter with respect to a putting aid in accordance with the present invention.

With reference to FIGS. 2–4, in particular, the putter stabilizer in accordance with the first embodiment of this invention is shown by way of example in combination with the putting aid described in of my prior application. As can be seen, the heel 20 of the putter 18 is disposed in parallel relation to the connector portion 16 of the T-adapter 10. The putter 18 could be placed in front of or behind the connector portion 16 with respect to direction of the stroke. In the illustrated embodiment, the putter 18 is coupled to the rear face of the connector portion 16.

The club can be coupled to the connector portion 16 of the T-adapter 10 in any suitable fashion as schematically shown with a dash dot dot line. For example, respective patches of Velcro-type hook and loop material can be adhesively secured to the face of each of the putter heel 20 and the connector portion 16 and the putter and T-adapter 10 secured together by engaging such Velcro portions. In the alternative, a bore can be drilled in both the heel 18 and the T-adapter 10 and a suitable connector inserted through the aligned bores to interconnect the putter and stabilizer. As a further alternative the putter can be secured to the T-adapter with a piece of tape which is wrapped around overlapping portions of these two structures. As yet a further alternative, a rubber or elastic band can be looped around the overlapping portions of the putter and T-adapter. Indeed, as described more fully below, utilizing a rubber or elastic band to interconnect these structures allows the putter and T-adapter to be easily disposed at an angle of other than 90° to allow, for example, the in to in method of putting to be practiced.

As is apparent from the foregoing, once the T-adapter 10 of FIG. 1 has been suitably coupled to a putter, the combination of T-adapter 10 and putter 18 is placed adjacent a suitable planer putting aid surface. For example, the base 12 of T-adapter 10 can be engaged with one of the two planer faces 22, 24 of a putting aid 14 of the type described in my co-pending application and schematically illustrated in FIGS. 2–4. Adapter 10 is illustrated as engaging the vertical side face 22 of the putting aid 14. However, as described below, the putter stabilizer can be placed against the inclined surface 24 of that putting aid to practice the in to in putting stroke.

Once the putting aid has been suitably secured to the green or to the carpet on which the golf swing is being practiced, as described in my aforementioned application, the ball 26 is placed on the ground in front of the putting aid 14 and the putter 18 is placed behind the ball with the putter stabilizer 10 engaging the planer surface of the putting aid. While maintaining the base portion 12 of the putter flat on the planer surface of the putting aid, the putter is drawn straight back and swung straight through to engage the ball 26 advance the same towards the target hole and/or cup (not shown). As is apparent because the putter 18 is fixed to the connector portion 16 of the T-adapter 10 it will be maintained square with respect to the putting aid 14 and hence square with respect to the stroke direction to ensure that the head will not turn in or open up during the swing. After a series of practice swings have been taken using the T-adapter 10 and putting aid 14 in accordance with the invention, the golfer will become accustomed to the feel of a square swing and his muscles will be gradually trained to repeat that stroke in play without the use of the adapter and/or putting aid.

Figure 5:
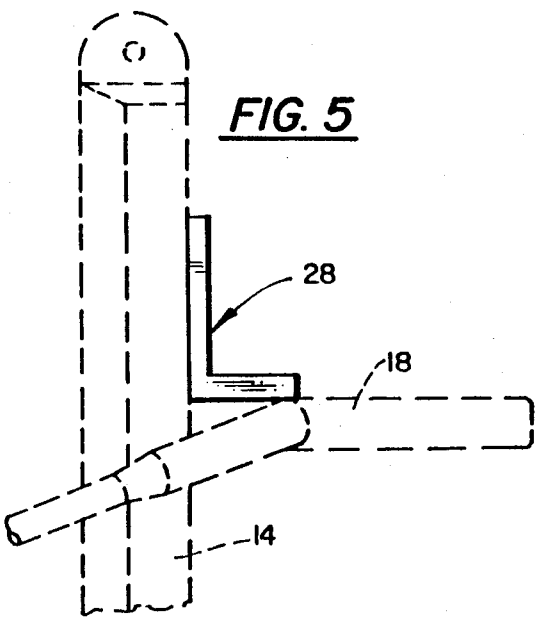
FIG. 5 is a top plan view of a putter stabilizer provided in accordance with an alternate embodiment of the invention.
Figure 6:
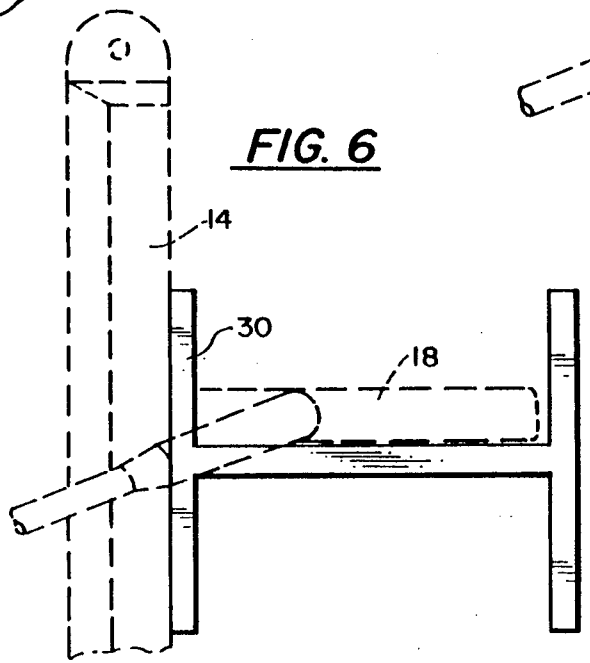
FIG. 6 is a top plan view of a further alternate stabilizer in accordance with the present invention.

As is apparent from the foregoing, the putting stabilizer provided in accordance with the present invention need not be formed as a T-adapter of the type illustrated in FIGS. 1–4 and could, for example, be in the form of an L-adapter 28, as illustrated in FIG. 5, or an H-adapter 30 as shown in FIG. 6. Furthermore, the putter stabilizer can be at any length deemed sufficient to provide a stable surface which can be guided along the putting aid. For example, the base 12 of the T-adapter can be between about 2" and about 20" in length. Likewise, the connector portion 16 of the putter stabilizer can be of any length deemed sufficient to allow a relatively rigid connection of the putter head to the stabilizer so as to ensure that the tendency to open or close the club during the swing will be prevented or substantially resisted.

As mentioned above, the stabilizer of the invention can be used to maintain the putter square with respect to any planer guide surface. Thus, while the putter stabilizer is illustrated, in particular, in association with the vertical side face of a putting aid, it is to be understood that the putter stabilizer could be used to maintain the putter square during an in to in stroke utilizing an inclined putter aid surface. The putter and the putter stabilizer need only be coupled together so that the plane of the base of the putting stabilizer is disposed at an angle of greater than 90° with respect to the longitudinal axis of the putter head. With the putter stabilizer and putter head 18 offset in this manner, the putter stabilizer can be slid along the inclined planar surface 24 of the putting aid 14 in full contact therewith while the putter is maintained with its longitudinal axis parallel to the ground on which the ball is disposed. In that regard, it has been found that coupling the putter to the putter stabilizer with an elastic or a rubber band allows these two parts to be easily angularly adjusted with respect to one another as required to accommodate an inclined planer guide surface. However, any other coupling means could likewise accommodate such an angular offset.

Figure 7:
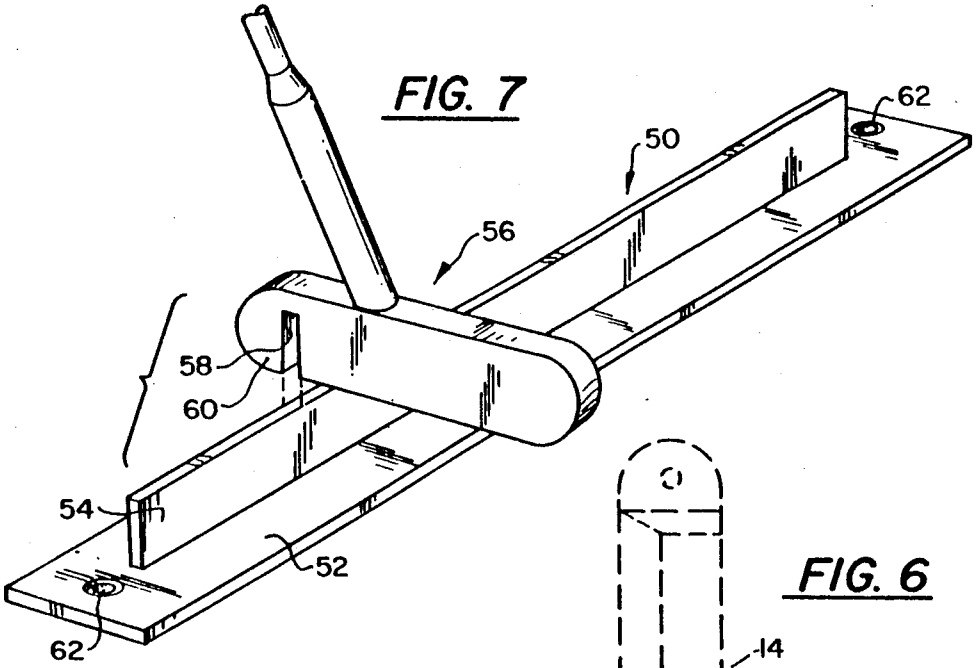
FIG. 7 is a perspective view of a putter and putter guide provided in accordance with the present invention.

As shown in FIG. 7, in particular, the putter guide 50 provided in accordance with present invention includes a substantially planer base 52 which is adapted to be secured to the putting surface and a fin or flange 54 which projects upwardly from the planer base. In the configuration illustrated in FIG. 7, the fin 54 is defined in a plane which is substantially perpendicular to the plane of the base 52.

In accordance with the present invention, a specialized putter 56 which has a slit or slot 58 can be provided for use with putter guide 50. The slit 58 has a shape which substantially corresponds with the cross-sectional shape of the fin 54 of the putter guide 50 with which the putter 56 is used. Thus in the embodiment of FIG. 7 the slit 58 is substantially rectangular and is defined adjacent the heel 60 of the putter 56. Furthermore, because the fin 54 of the putter guide 50 shown in FIG. 7 is disposed substantially perpendicularly with respect to the base 52, the slit in the putter head is defined in a plane which is substantially perpendicular to the longitudinal axis of the putter head.

The putter guide 50 itself can be secured to the putting surface in any desired fashion. For example, an aperture 62 can be defined at each longitudinal end of the base 52 through which a tee 64 (FIG. 9) is inserted to secure the same to the putting green. In the alternative or in addition, a Velcro-type hook material (not shown in particular) can be provided on the undersurface of the base 52 so that the base 52 can be secured, for example, to household carpeting.

The dimensions of the base 52 of the putter guide 50 provided in accordance with the embodiment of FIG. 7 can of course be varied depending upon the thickness of the base and the manner in which the putting system is used. For example, if the base is made sufficiently wide, the upper surface of the base can be used as a putting surface and can be provided, for example, with an artificial turf material to simulate the material of the green. An extension of the artificial turf (not shown) which extends forwardly of the putting aid can then be provided, on which surface the putted ball can roll to a receiving device or cup (not shown).

In the alternative, the width of the base can be minimized so that it is merely sufficient to stabilize the fin and mount the same to the ground. When the base is minimized in this fashion, the slot in the putter head can be shaped substantially as an inverted T so that both the fin and the base are received within the slot. This allows the putter to be slid along the length of the putter guide and thus properly follow a desired stroke while maintaining the putter head square with respect to the direction of the stroke. Such a configuration allows the putter to properly engage a ball disposed on the ground rather than on the base.

As a further alternative, although not illustrated in particular, the fin can be substantially triangularly shaped, the base of the triangle defining the base of the putter guide. The putter would have a correspondingly shaped slit for allowing the putter to be slid along the triangularly shaped putter guide. A flange can be defined at each end of such a triangularly shaped putter guide to allow the putter guide to be attached, for example, to the green.

Figure 8:
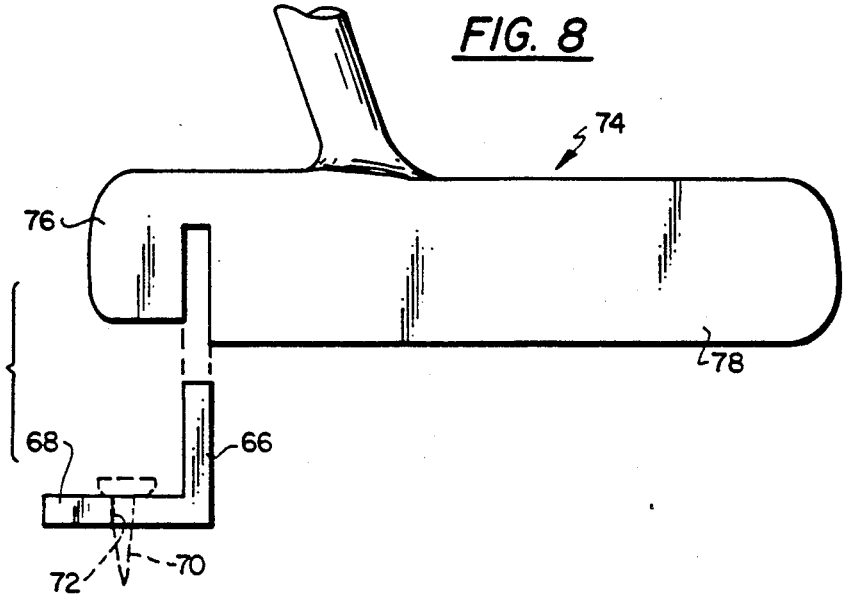
FIG. 8 is an end elevational of an alternate configuration of the putter guide in accordance with the invention.

As illustrated in FIG. 8, yet a further alternate configuration for the putter guide is shown wherein the fin 66 and base 68 are interconnected so as to define an L. Again the base 68 of the putter guide can be coupled to the putting surface in any suitable fashion such as for example by inserting a tee 70 through an apertures 72 defined in each end of the putter guide. In that regard, as illustrated in FIG. 8, the attachment structure should be provided centrally of the base 68 or towards the side edge of the base 68 remote from the fin 66 to maintain the base 68 in parallel relation to the putting surface in spite of forces which may act on the fin 66.

With reference again to the embodiment of FIG. 8, if desired, the putter 74 can be formed so as to decrease the height of the heel 76 with respect to the forward portion 78 thereof. In this manner, the height of the base 68 of the putter guide can be accommodated so that the forward portion 78 of the putter 74 can still be guided immediately adjacent to the putting surface into contact with a ball disposed thereon.

Figure 9:
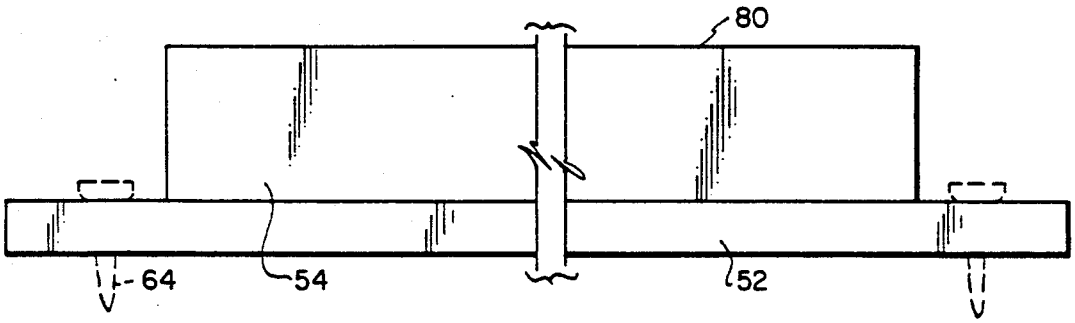
FIG. 9 is a front view of a putter guide provided in accordance with one embodiment of the invention.
Figure 10:
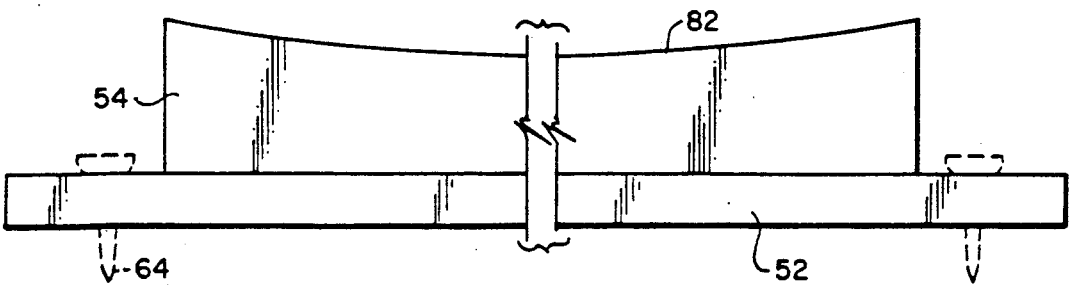
FIG. 10 is a front view of an alternate embodiment of the putter guide of the invention.

When the putting stroke to be practiced is the straight through putting method, the fin 54 is most desirably disposed perpendicularly with respect to the base and can have a substantially straight or planer upper surface 80 as illustrated in FIG. 9. When it is desired for the putter head to dip mid swing, the upper edge of the fin 54 can be in the form of an arc or scoop 82 as shown in FIG. 10. As a further alternative, particularly where the in to in stroke is to be practiced, the fin 54 can be oriented at an angle of less than 90° with respect to the base 52. Defining the upper edge of the inclined fin 54 as a scoop can provide the proper trajectory of the putter head for that stroke. The slot defined in the putter head is correspondingly inclined to allow the putter head to be maintained with its longitudinal axis parallel to the putting surface. The fin may also be defined at an angle with respect to the base where the straight through putting method is to be practiced provided the upper edge thereof is maintained straight or planer. Again, the slot defined in the putter head would be corresponding inclined.

Figure 13:
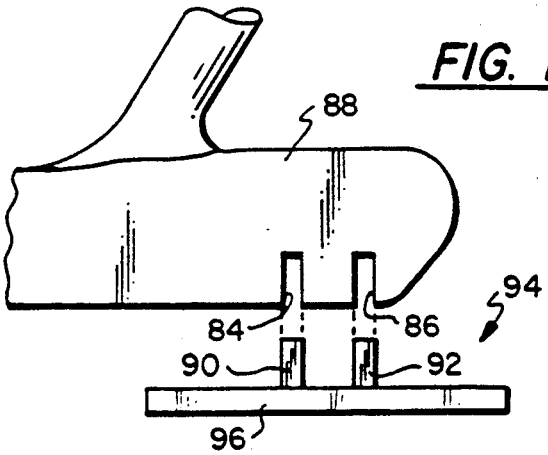
FIG. 13 is an exploded end elevational view of an alternate putter and putter guide in accordance with the invention.

Yet a further alternative embodiment of a putter and putter guide in accordance with the invention is shown in FIG. 13. In accordance with the illustrated embodiment, first and second slots 84, 86 can be defined in the heel 88 of the putter head which slidably engage first and second vertically extending fins 90, 92 of the putter guide. Again, the fins 90, 92 and slots 84, 86 can be defined so as to be disposed at an angle of about 90° with respect to the plane of the base 96 of the putter guide 94 or can be inclined with respect thereto. Further, the angle of inclination of the fins 90, 92 and angle of inclination of slots 84, 86 correspond so that the longitudinal axis of the putter head is maintained in parallel relation to the plane of the putter guide base 96 and the putting surface.

A putter guide as described above could be formed from any suitable material. Thus the putter guide could be formed, for example, from wood, metal or plastic. Furthermore, the fin can be formed integrally with the base or can be formed separately and fixedly or adjustably coupled to the base. It is to be understood, however, that the putter head will have a slot defined therein in accordance with the angle at which the fin is disposed with respect to the base. Therefore, each putter head can be used with only a single angular orientation of the fin.

Figure 11:
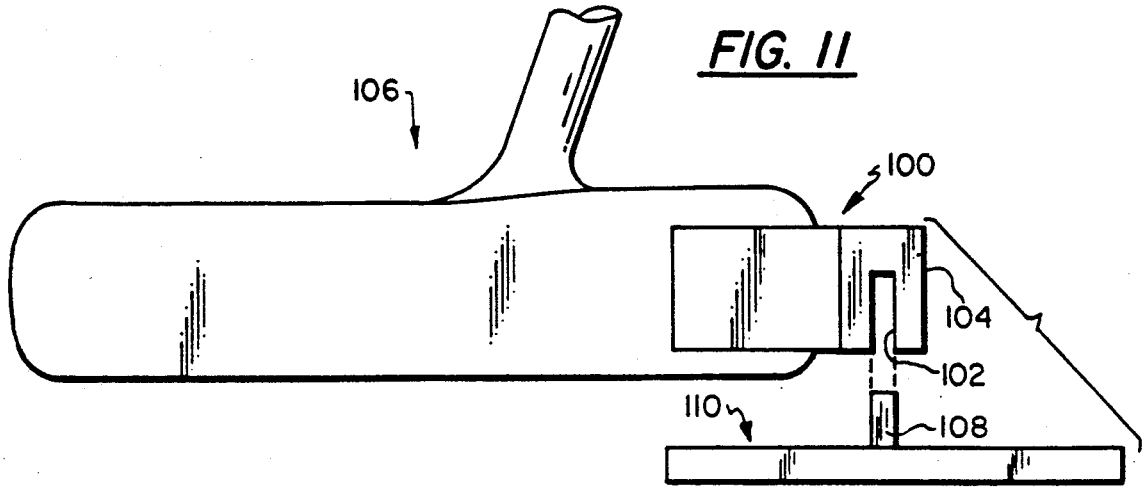
FIG. 11 is an exploded end elevational view of a slotted stabilizer in accordance with the invention.

Yet a further, alternate configuration in accordance with the present invention is illustrated by way of example in FIG. 11. The putting aid 100 is substantially similar to the T-adapter stabilizer described above with reference to FIGS. 1–4 but is further characterized in that a slot 102 is defined longitudinally of the base portion 104 of the T-adapter 100. The slot 102 opens downwardly so that when the putter stabilizer is coupled to the putter 106, the slot 102 can be aligned with a fin 108 provided on a putter guide 110 and the combination of putter 106 and putter stabilizer 100 can be slid along the fin 108 for practicing putting strokes. As is apparent, the putter stabilizer 100 and putter guide 110 combination will maintain the putter head square with respect to the stroke direction so that putting strokes can be practiced and the golfer's muscles trained to improve his game. The putter stabilizer of FIG. 11 is particularly advantageous as it can be used with a putter guide as illustrated and described above or can be used with a putting aid of the type illustrated in FIGS. 1–4 by sliding the base 104 of the putter stabilizer 100 along the planer surface 22 of the putting aid 14, as described above with reference to FIGS. 2–4.

Figure 12:
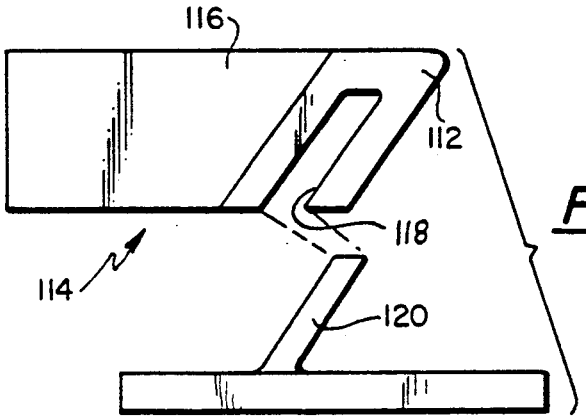
FIG. 12 is an exploded end elevational view of an alternate embodiment of the slotted stabilizer.

As shown in FIG. 12, the base 112 of the putter stabilizer 114 can be inclined at an angle with respect to the connector portion 116 thereof to allow the putter stabilizer 114 to be slid along an inclined planer surface, particularly to practice the in to in putting stroke. The slot 118 defined in the putter stabilizer is correspondingly inclined so that, in the alternative, the putter (not shown) can be slid along an inclined putter guide fin 120.

While the invention has been described in connection with what is presently considered to be the most practical and preferred embodiment, it is to be understood that the invention is not to be limited to the disclosed embodiments, but, on the contrary, it is intended to cover various modifications and equivalent arrangements included within the spirit and scope of the appended claims.

What is claimed is:

1. A golf club in combination with a putter stabilizer;

said golf club having a shaft, a golf club head defined at a first end of said shaft and a handle defined at a second end of said shaft, said golf club head having a longitudinal axis, a toe portion at one end of said longitudinal axis and a heel portion at the other end of said longitudinal axis, a forward face and rearward face;

said putter stabilizer being detachably, adjustably coupled to said golf club head, said putter stabilizer comprising a substantially planer base portion having a first end, a second end, and a longitudinal axis, and a substantially planer connector portion having a first end, a second end, and a longitudinal axis, said base portion having a length substantially greater than a thickness of said golf club head, said first end of said connector portion being connected to said base portion so that a plane of said connector portion is substantially perpendicular to the plane of said base portion, said connector portion being detachably and adjustably coupled to one of said toe portion and said heel portion so that said plane of said connector portion is parallel to one of said forward face and said rearward face and so that the longitudinal axis of said golf club head intersects said plane of said base portion;

whereby said planer base portion presents a planer face for sliding engagement with a planer surface disposed adjacent one of the toe and the heel of the putter and whereby the forward face of said golf club head can be maintained square with respect to the planer surface and a corresponding stroke direction.

2. The combination of claim 1, wherein said longitudinal axis of said connector portion is substantially perpendicular to the plane of said base portion.

3. The combination of claim 1, wherein said connector portion is coupled to said golf club head with one of a hook and a loop material.

4. The combination of claim 1, wherein said connector portion is coupled to said golf club head with an elastic band.

5. The combination of claim 1, wherein the connector portion is coupled to the golf club head with a bolt, said connector portion having an aperture for receiving said bolt.

6. The combination of claim 1, wherein connector portion is coupled to said golf club head with adhesive tape.

7. The combination of claim 1 in further combination with an apparatus for practicing golf strokes comprising an elongated element having a bottom face, a longitudinal axis and first and second longitudinal ends and means defining a substantially planer guide surface extending along at least a substantial portion of the length of said elongated element.

8. The combination of claim 1, wherein said connector portion is mounted to a mid section of said base portion whereby said putter stabilizer is substantially Tshaped.

9. The combination of claim 1, wherein said connecting portion is mounted to one end of said base portion whereby said putter stabilizer is substantially L-shaped.

10. The combination of claim 1, wherein said base portion has a longitudinal slot defined therein, said slot opening along an undersurface of said base portion so as to face a playing surface.

11. The combination of claim 10 in further combination with an elongate element having a longitudinal axis, a bottom face and first and second longitudinal ends and fin element which extends vertically upwardly with respect to a plane of said bottom face.

12. The combination of claim 11, wherein said fin element is defined at an angle of about 90° with respect to the plane of said bottom face.

13. The combination of claim 11, wherein said fin has a vertical height which varies along the length thereof;

14. A golf club in combination with a putter stabilizer;

said golf club having a shaft, a golf club head defined at a first end of said shaft and a handle defined at a second end of said shaft, said golf club head having an longitudinal axis, an toe portion at one end of said longitudinal axis and a heel portion at the other end of said longitudinal axis, a forward face and a rearward face, said putter stabilizer being detachably, adjustably coupled to said golf club head, said putter stabilizer consisting essentially of a substantially planer base portion having a first end, a second end, and a longitudinal axis, and s substantially planer connector portion having a first end, a second end, and a longitudinal axis, said base portion having a length substantially greater than a thickness of said golf club head said first end of said connector portion being connected to said base portion so that a plane of said connector portion is substantially perpendicular to the plane of said base portion, said connector portion being detachably and adjustably coupled to one of said toe portion and said heel portion so that said plane of said connector portion is parallel to one of said forward face and said rearward face and so that the longitudinal axis of said golf club head intersects said plane of said base portion;

whereby said planer base portion presents a planer face for sliding engagement with a planer surface disposed adjacent one of the toe and the heel of the putter and whereby the forward face of said golf club head can be maintained square with respect to the planer surface and a corresponding stroke direction.

* * * * *